US005976333A

United States Patent [19]

Pate

[11] Patent Number: 5,976,333

[45] Date of Patent: Nov. 2, 1999

[54] COLLECTOR BAR

[76] Inventor: Ray H. Pate, 1923 Chestnut Grove Rd., Knoxville, Tenn. 37932

[21] Appl. No.: 09/003,092

[22] Filed: Jan. 6, 1998

[51] Int. Cl.[6] ..... C25C 3/16

[52] U.S. Cl. ..... 204/279; 204/294

[58] Field of Search ..... 204/279, 243.1, 204/294

[56] References Cited

U.S. PATENT DOCUMENTS

| | | | |
|---|---|---|---|
| 1,736,745 | 3/1929 | Lohmann . | |
| 3,492,463 | 1/1970 | Wringer et al. . | |
| 3,551,319 | 12/1970 | Elliot . | |
| 3,867,562 | 2/1975 | Fischer et al. . | |
| 4,417,097 | 11/1983 | Das | 204/279 |
| 4,488,955 | 12/1984 | Bertaud et al. | 204/279 X |
| 4,647,356 | 3/1987 | Leroy . | |
| 4,647,358 | 3/1987 | Bartsch et al. . | |
| 5,277,776 | 1/1994 | Borner et al. | 204/279 |
| 5,464,519 | 11/1995 | Tomba et al. | 204/279 X |
| 5,538,607 | 7/1996 | Pate . | |
| 5,597,461 | 1/1997 | Pate . | |

*Primary Examiner*—Donald R. Valentine
*Attorney, Agent, or Firm*—Diller, Ramik & Wright. PC

[57] ABSTRACT

A collector bar adapted for utilization with carbon during the production of molten metal, such as aluminum, under Hall Héroult applications includes a one-piece metallic extruded and/or drawn tube of relatively low electrical conductivity, such as steel or ferrous metal and a one-piece rod of relatively high electrical conductivity, such as copper. The tube is in encircling relationship to the rod and the rod and tube have surfaces in intimate surfaces-to-surface contact. The rod has an exterior profile exactly complementing an interior profile of the tube, or alternately the rod is relatively elongated and narrow and opposite longitudinal edges thereof are in intimate surface-to-surface contact with parallel opposite surfaces of the tube or opposite diagonal corners of the tube.

30 Claims, 2 Drawing Sheets

FIG. 1
PRIOR ART
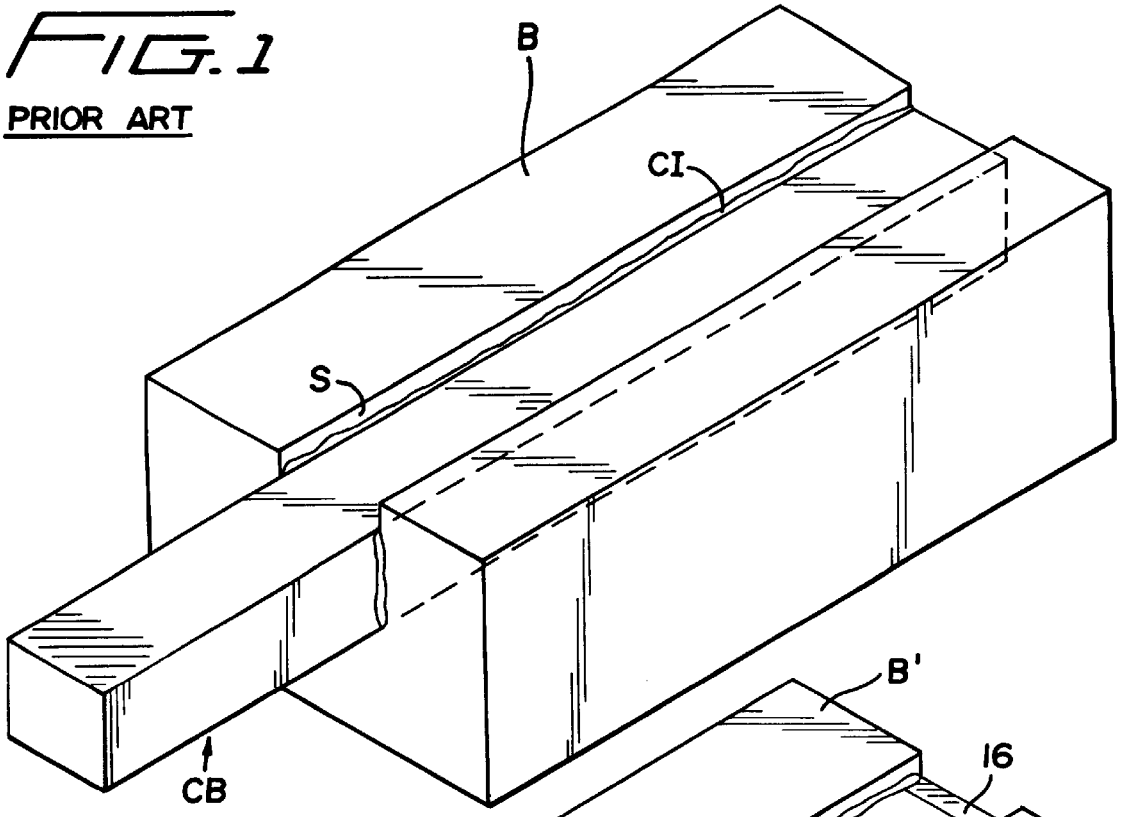
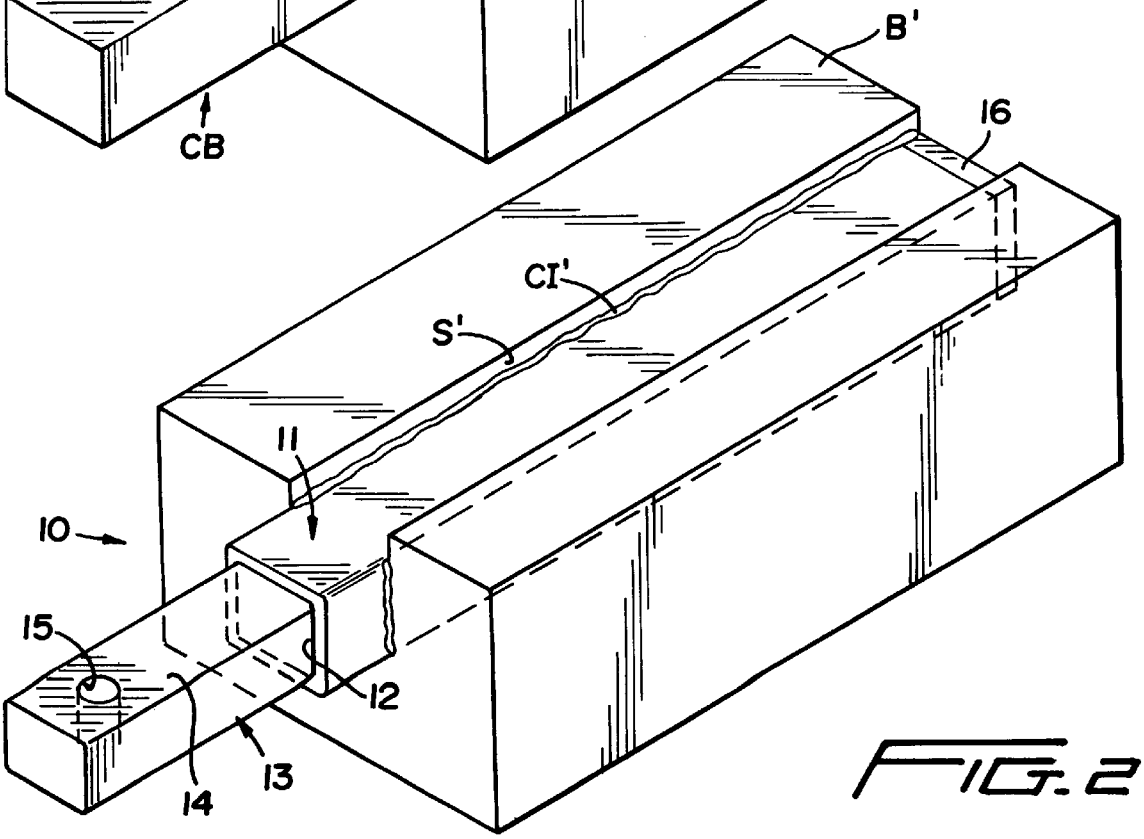
FIG. 2

FIG. 4
FIG. 6
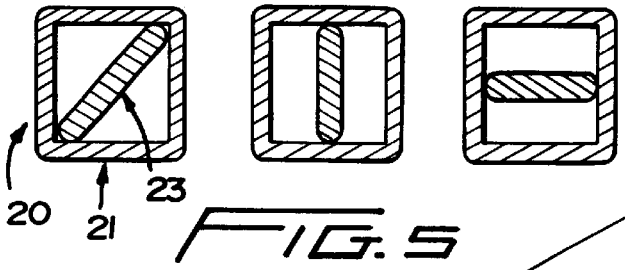
FIG. 5
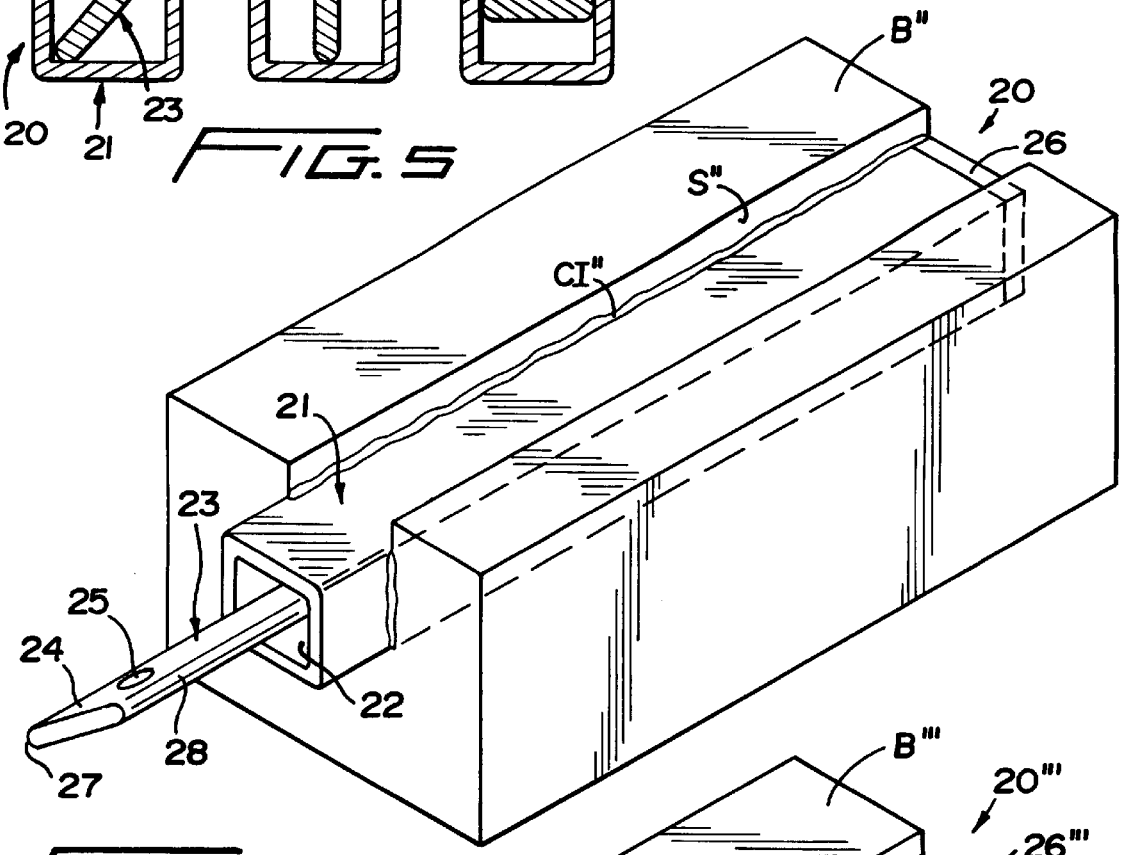
FIG. 3
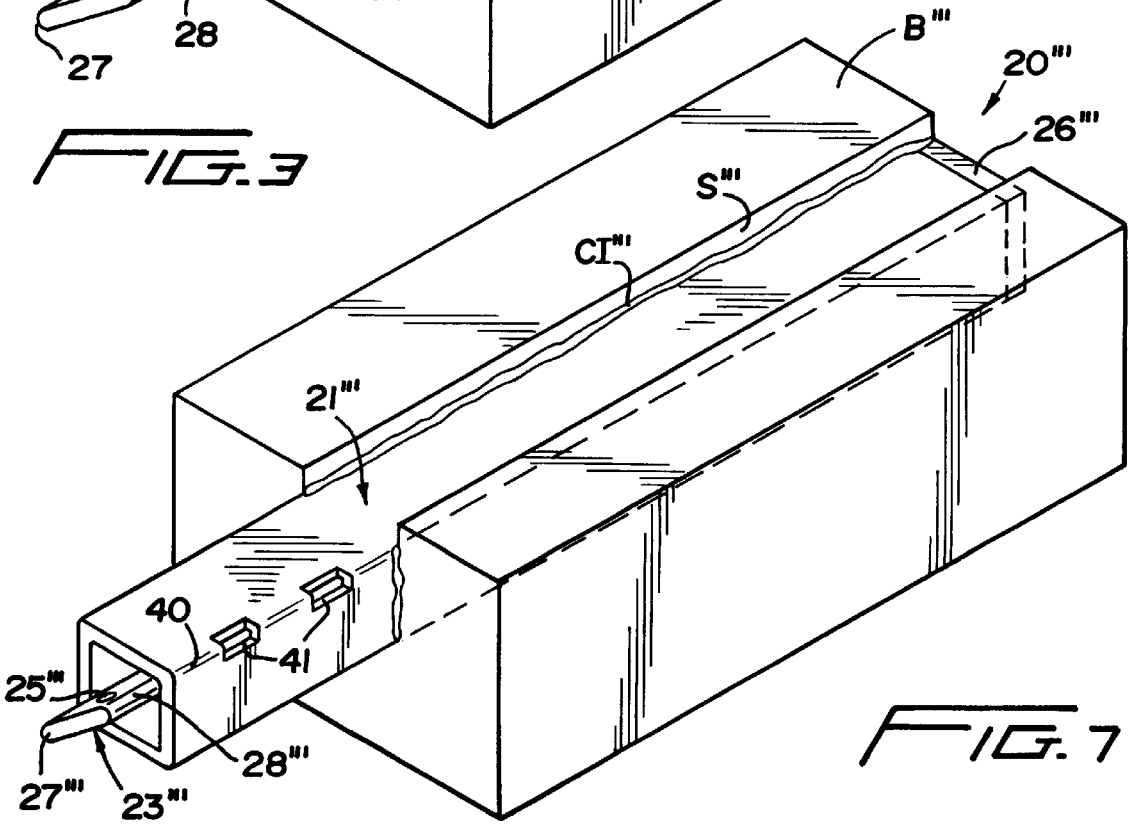
FIG. 7

COLLECTOR BAR

BACKGROUND OF THE INVENTION

U.S. Pat. No. 5,538,607 in the name of Ray H. Pate describes Hall-Héroult technology for the production of molten metal, specifically molten aluminum, utilizing carbon blocks and associated anode bars, cathode bars etc. Such collector bars, be they an anode bar or cathode bar, are subject to rapid consumption necessitating refurbishment and/or replacement costing millions of dollars. In the Pate U.S. Pat. No. (5,538,607) an anode assembly is disclosed in which an anode bar is housed in a metal sleeve of relatively hard electrically conductive material, though the conductivity is less than the higher relative electrical conductivity of the copper anode bar. However, the harder outer metal sleeve resists consumption during use while facilitating current flow in as efficient a manner as possible. Thus, though the patent to Pate provides a novel long lasting slow consuming anode assembly, the industry lacks a cathodic current collector which is as efficient and long lasting.

Moreover, cathode collectors remain costly from a fabrication standpoint, as is perhaps best evidenced by the multi-pieced cathodic current collector disclosed in U.S. Pat. No. 3,551,319 in the name of Charles H. Elliott. This patent discloses a cathodic current collector formed by an L-shaped or U-shaped ferrous material sheath which houses a copper core and is closed by one or more ferrous blocks, all of which are welded to each other and are suitably installed in tile cell lining of a conventional reduction cell spaced about and supported by a plurality of carbon blocks. The copper core reduces resistance to achieve efficient current flow, whereas the current sheath affords shielding/protection. However, the cost of fabrication of the relatively complex cathodic collector is quite high due to both the cost of materials involved, as well as the assembly thereof.

SUMMARY OF THE INVENTION

In keeping with the foregoing, a major object of the present invention is to provide a novel collector bar, preferably a cathodic or cathode collector bar which is extremely inexpensive to manufacture yet provides both high electrical conductivity and long life. Preferably, the collector bar is constructed as a one-piece drawn metallic tube of relatively low electrical conductivity and a one-piece rod of relatively high electrical conductivity, such as copper. The tube is in encircling relationship to the rod with the latter components being in intimate surface-to-surface contact. Preferably, the rod is relatively elongated and is substantially polygonal in transverse cross section having opposite longitudinal edge portions which are in intimate surface-to-surface contact with opposite interior surface portions of the tube. Preferably the interior surface portions which are in contact with each other are the interior parallel surfaces of the tube or the diametrically opposite interior corner surfaces of the tube. One end of the tube is preferably closed by a ferrous end cap and the copper rod is exposed at the end of the collector bar opposite the end cap for connection to a Source of electrical power. The tube is seated in a slot of a carbon block and is bonded thereto by cast iron or similar suitable bonding material.

Preferably, the exterior ferrous tube is drawn or extruded as a continuous tube and can be conventionally sized during extrusion or drawing to a desired exterior and a desired interior profile(s) and a dimension(s). For example, a ferrous extruded or drawn tube might have an opening or bore measuring, approximately 5½"×5½" into which an identically exteriorly sized copper rod can be inserted, preferably when the ferrous or steel tube is warm so that upon insertion of the identically dimensioned copper rod, the steel tube will cool to intimately retain the copper rod therein.

In further accordance with the present invention, the tube may have a plurality of slots along a corner edge thereof through which tack welding can be utilized to secure the copper rod immovably within the steel tube.

Accordingly, in keeping with the present invention, the cathode collector bar is relatively inexpensive to manufacture, install, maintain and both high efficiency and long life can be expected under normal operating conditions.

With the above and other objects in view that will hereinafter appear, tile nature of the invention will be more clearly understood by reference to the following detailed description, the appended claims and the several views illustrated in the accompanying drawings.

BRIEF DESCRIPTION OF THE DRAWINGS

FIG. 1 is a perspective view of a conventional cathode collector bar, and illustrates a cathode bar seated in a groove of a carbon block and conventionally bonded thereto.

FIG. 2 is a perspective view of a novel cathode collector bar of the present invention, and illustrates a one-piece metallic extruded/drawn tube of relatively low electrical conductivity housing therein in intimate surface-to-surface contact a one-piece rod of relatively high electrical conductivity with one end of the tube being closed by an end cap.

FIG. 3 is a perspective view of another novel cathode collector bar of the present invention, and illustrates a carbon block, a one-piece extruded/drawn metallic tube of relatively low electrical conductivity, and a one-piece rod of relatively high electrical conductivity telescoped therein in wedged corner surface-to-corner surface relationship.

FIG. 4 is a transverse cross-sectional view taken through the cathode collector bar of FIG. 3, and illustrates the manner in which corners of the rod bear against internal corners of the tube.

FIG. 5 is a transverse cross-sectional view through another cathode collector bar of the invention, and illustrates a narrow vertically disposed rod having longitudinal edges in surface-to-surface contact with opposite upper and lower parallel interior surfaces of the tube.

FIG. 6 is a transverse cross-sectional view of the present invention and illustrates a copper rod disposed horizontally internally of a ferrous tube.

FIG. 7 is a perspective view of another cathode collector bar of the invention similar to the cathode collector bar of FIG. 3, and illustrates a plurality of slots along a corner of the tube for tack welding thereto the internal rod.

DESCRIPTION OF THE PREFERRED EMBODIMENTS

A conventional cathode collector bar CB is illustrated in FIG. 1 of the drawings in conjunction with a carbon block B which includes a slot S receiving the collector bar B. Molten and subsequently solidified cast iron CI or similar material can be utilized to secure the collector bar CB in the groove or slot S of the carbon block B. An exposed end portion (unnumbered) of the cathode bar B is conventionially connected to an electrical power source. The collector bar CB can, of course, be encased in a sheath defined by a plurality of individual elements in the manner heretofore described relative to Elliott U.S. Pat. No. 3,551,319.

In keeping with the present invention. a novel cathode collector bar is illustrated in FIG. 2 of the drawings and is generally designated by the reference numeral 10. The cathode collector bar 10 is particularly adapted for utilization with a carbon block B' having a conventional slot or groove S'.

Preferably, the collector bar 10 comprises a one-piece extruded or drawn metallic tube 11 of relatively low electrical conductivity and high strength, such a steel. The tube 11 includes a central generally polygonal opening 12 into which is inserted a one-piece rod 13 of relatively high electrical conductivity, such as copper. The one-piece copper rod 13 is in initimate surface-to-surface contact with the interior surfaces (unnumbered) defining the opening 12 of the tube 11. An end portion 14 of the rod 13 is exposed and includes an opening 15 for connecting a current-carrying cable to the rod 13. An end of the rod 13 opposite the rod end portion 14 is housed entirely within the tube 11 and the latter is closed by an end cap 16 of steel or like material which is welded to the tube 11 and to the end (unnumbered) of the rod 13 adjacent thereto. Cast iron CI' or similar equivalent material adheres, secures and bonds the cathode collector bar 10 within the slot or groove S' of the carbon block B'. The entire assembly illustrated in FIG. 2 is housed in a conventional manner within an electrolytic cell (not shown) associated with tile Hall Héroult process.

During the hot or cold extrusion or drawing of the tube 11, the same remains relatively hot/warm for a considerable length of time during which the rod 13 can be inserted/forcefully driven therein. Upon cooling. the tube 11 shrinks and the interior surfaces defining the opening or bore 12 are in intimate surface-to-surface gripping contact with the exterior surfaces (unnumbered) of the rod 13.

Another novel cathode collector bar is illustrated in FIGS. 3 and 4 of the drawings and is generally designated by the reference numeral 20. The collector bar 20 includes a one-piece extruded metallic tube of relatively low electrical conductivity. such as steel or other ferrous material. which is generally designated by the reference numeral 21. The tube 21 defines an interior bore 22 of a generally polygonal cross-sectional configuration and housed therein in intimate relationship and in surface-to-surface contact therewith is a one-piece metallic rod 23 of relatively high conductivity. such as copper. The rod 23 is relatively elongated flat and narrow and includes opposite longitudinal edges or corners 27, 28 which bear against and are in intimate surface-to-surface contact with internal corners (unnumbered) of the tube 21, as is best illustrated in FIG. 4. An opening 25 is provided in an exposed end 24 of the rod 23 to connect the same to a source of electricity. An end cap 26 of steel or like material is welded to the tube 21 and cast iron CI" secures the tube 21 in all associated groove or slot S" of a conventional carbon block B".

Reference is made to FIG. 7 of the drawings which illustrates another cathode collector bar identical to the cathode collector bar 23 of FIG. 3 which has been identified with identical though triple primed reference characters. In the cathode collector bar 20''' of FIG. 7, a steel tube 21''' is provided along a longitudinal corner 40 thereof with a plurality of spaced through slots 41 of which only two are illustrated, though such slots 41 essentially run the entire length of the tube 21''' along the corner 40. The slots 41 and, if necessary or desirable, like slots at the diametrically opposite corner of the tube 21''', are utilized to spot weld or tack weld the tube 20''' to the rod 23'''. Otherwise, the collector bar 20''' is identical to the collector bar 20 of FIG. 3.

The rod 23 or the rod 23''' can be disposed in parallel relationship to the walls of the tube, as is illustrated in FIGS. 5 and 6 of the drawings. The particular orientation of the rod, be it vertical (FIG. 5) or horizontal (FIG. 6) is immaterial so long as the longitudinal edges or corners thereof are in intimate surface-to-surface contact with the interior surfaces of the associated tube.

Although a preferred embodiment of the invention has been specifically illustrated and described herein, it is to be understood that minor variations may be made in the apparatus without departing from the spirit and scope of the invention as defined tile appended claims.

What is claimed is:

1. A collector bar particularly adapted to utilization with a carbon block during the production of molten metal under Hall-Héroult applications comprising a one-piece metallic tube of relatively low electrical conductivity, a one-piece rod of relatively high electrical conductivity, said tube being in encircling relationship to said rod, said tube and rod being in intimate surface-to-surface contact, said tube being of a polygonal transverse cross-sectional configuration, said rod being of a polygonal transverse cross-sectional configuration, said tube being an extruded/drawn tube, said rod being relatively flat and elongated and including opposite longitudinal edge portions, said rod being of a relatively narrow polygonal transverse cross-sectional configuration, and said opposite longitudinal edge portions of said rod being, in surface-to-surface contact with opposite interior surface portions of said tube.

2. The collector bar as defined in claim 1 including means for securing said rod and tube together through said tube.

3. The collector bar as defined in claim 1 including mean for securing said rod and tube together through at least one opening in said tube.

4. The collector bar as defined in claim 1 including means for securing said rod and tube together through a plurality of openings in said tube.

5. The collector bar as defined in claim 1 including means for securing said rod and tube together through a plurality of openings in and along said tube.

6. A collector bar particularly adapted to utilization with a carbon block during the production of molten metal under Hall-Héroult applications comprising a one-piece metallic tube of relatively low electrical conductivity, a one-piece rod of relatively high electrical conductivity, said tube being in encircling relationship to said rod, said tube and rod being in intimate surface-to-surface contact, said tube being of a polygonal transverse cross-sectional configuration, said rod being of a polygonal transverse cross-sectional configuration, said tube being an extruded/drawn tube, said rod being relatively flat and elongated and including opposite longitudinal edge portions, said rod being of a relatively narrow polygonal transverse cross-sectional configuration, and said opposite longitudinal edge portions of said rod being in surface-to-surface contact with opposite parallel interior surface portions of said tube.

7. The collector bar as defined in claim 6 including means for securing said rod and tube together through a plurality of openings in said tube.

8. The collector bar as defined in claim 6 including means for securing said rod and tube together through said tube.

9. The collector bar as defined in claim 6 including means for securing said rod and tube together through at least one opening in said tube.

10. The collector bar as defined in claim 6 including means for securing said rod and tube together through a plurality of openings in and along said tube.

11. A collector bar particularly adapted to utilization with a carbon block during the production of molten metal under Hall-Héroult applications comprising a one-piece metallic tube of relatively low electrical conductivity, a one-piece rod of relatively high electrical conductivity, said tube being in encircling relationship to said rod, said tube and rod being in intimidate surface-to-surface contact, said tube being of a polygonal transverse cross-sectional configuration, said rod being of a polygonal transverse cross-sectional configuration, said tube being an extruded/drawn tube, said rod being relatively flat and elongated and including opposite longitudinal edge portions, said rod being of a relatively narrow polygonal transverse cross-sectional configuration, and said opposite longitudinal edge portions of said rod being in surface-to-surface contact with diametrically opposite interior corner surface portions of said tube.

12. The collector bar as defined in claim 11 including means for securing said rod and tube together through a plurality of openings in said tube.

13. The collector bar as defined in claim 11 including means for securing said rod and tube together through said tube.

14. The collector bar as defined in claim 11 including means for securing said rod and tube together through at least one opening in said tube.

15. The collector bar as defined in claim 11 including means for securing said rod and tube together through a plurality of openings in and along said tube.

16. The collector bar as defined in claim 11 including means for securing said rod and tube together along at least one of said corner surface portions.

17. The collector bar as defined in claim 11 including means for securing said rod and tube together through an opening at one of said corner surface portions.

18. The collector bar as defined in claim 11 including means for securing said rod and tube together through a plurality of openings along one of said corner surface portions.

19. A collector bar particularly adapted for utilization with a carbon block during the production of molten metal under Hall-Héroult applications comprising a one-piece metallic tube of relatively low electrical conductivity, a one-piece rod of relatively high electrical conductivity, said tube being in encircling relationship to said rod, said tube and rod being in intimate surface-to-surface contact, and said tube being of a polygonal transverse cross-sectional configuration, said rod and tube having axially opposite terminal end portions, a first rod end portion being located within a first tube end portion, means for closing said first tube end portion, and a second rod end portion projecting beyond a second tube end portion.

20. The collector bar as disclosed in claim 19 including means for connecting said second rod end portion to an electrical power supply.

21. The combination of a carbon block and an electrical conduction assembly particularly adapted for utilization during the production of molten metal under Hall-Héroult applications comprising a carbon block having an exterior surface through which opens a groove of a predetermined cross-sectional configuration and an electrical conduction assembly seated in said groove, said electrical conduction assembly including a one-piece metallic tube of relatively low electrical conductivity seated in said groove, means for securing said tube in said groove, a one-piece rod of relatively high electrical conductivity, said tube being in encircling relationship to said rod, said tube and rod being in intimate surface-to-surface contact, and said tube and groove being of a polygonal transfer cross-sectional configuration.

22. The combination as defined in claim 21 wherein at least one end of said rod projects outwardly beyond an end of said tube, and means for connecting said rod one end to a source of electrical energy.

23. The combination as defined in claim 22 wherein said rod is relatively flat and elongated and includes opposite longitudinal edge portions, said rod is of a relatively narrow polygonal transverse cross-sectional configuration, and said opposite longitudinal edge portions of said rod are in intimate surface-to-surface contact with opposite interior surface portions of said tube.

24. The combination as defined in claim 22 wherein said rod is relatively flat and elongated and includes opposite longitudinal edge portions, said rod is of a relatively narrow polygonal transverse cross-sectional configuration, and said opposite longitudinal edge portions of said rod are in intimate surface-to-surface contact with opposite parallel interior surface portions of said tube.

25. The combination as defined in claim 22 wherein said rod is relatively flat and elongated and includes opposite longitudinal edge portions, said rod is of a relatively narrow polygonal transverse cross-sectional configuration, and said opposite longitudinal edge portions of said rod are in intimate surface-to-surface contact with diametrically opposite interior corner surface portions of said tube.

26. The combination as defined in claim 21 wherein at least one end of said rod projects outwardly beyond an end of said tube and an end surface of said block, and means for connecting said rod one end to a source of electrical energy.

27. The combination as defined in claim 21 wherein said groove, tube and rod are each of a polygonal transverse cross-sectional configuration.

28. The combination as defined in claim 21 wherein said rod is relatively flat and elongated and includes opposite longitudinal edge portions, said rod is of a relatively narrow polygonal transverse cross-sectional configuration, and said opposite longitudinal edge portions of said rod are in intimate surface-to-surface contact with opposite interior surface portions of said tube.

29. The combination as defined in claim 21 wherein said rod is relatively flat and elongated and includes opposite longitudinal edge portions, said rod is of a relatively narrow polygonal transverse cross-sectional configuration, and said opposite longitudinal edge portions of said rod are in intimate surface-to-surface contact with opposite parallel interior surface portions of said tube.

30. The combination as defined in claim 21 wherein said rod is relatively flat and elongated and includes opposite longitudinal edge portions, said rod is of a relatively narrow polygonal transverse cross-sectional configuration, and said opposite longitudinal edge portions of said rod are in intimate surface-to-surface contact with diametrically opposite interior corner surface portions of said tube.

* * * * *